US009765740B2

(12) United States Patent
Takaoku et al.

(10) Patent No.: US 9,765,740 B2
(45) Date of Patent: Sep. 19, 2017

(54) FUEL INJECTION VALVE

(71) Applicant: Hitachi Automotive Systems, Ltd., Hitachinaka-shi, Ibaraki (JP)

(72) Inventors: Atsushi Takaoku, Hitachinaka (JP); Yasuo Namaizawa, Hitachinaka (JP); Hideharu Ehara, Hitachinaka (JP); Masahiro Soma, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 209 days.

(21) Appl. No.: 14/374,782

(22) PCT Filed: Jan. 16, 2013

(86) PCT No.: PCT/JP2013/050616
§ 371 (c)(1),
(2) Date: Jul. 25, 2014

(87) PCT Pub. No.: WO2013/118542
PCT Pub. Date: Aug. 15, 2013

(65) Prior Publication Data

US 2014/0367498 A1 Dec. 18, 2014

(30) Foreign Application Priority Data

Feb. 10, 2012 (JP) ..... 2012-027671

(51) Int. Cl.
*F02M 51/06* (2006.01)
*F02M 63/00* (2006.01)
(Continued)

(52) U.S. Cl.
CPC ..... *F02M 63/0071* (2013.01); *F02M 51/061* (2013.01); *F02M 51/0671* (2013.01);
(Continued)

(58) Field of Classification Search
CPC ..... F02M 51/0603; F02M 51/0671; F02M 2200/8084; F02M 2200/02; F02M 61/1886; Y10T 29/49306
(Continued)

(56) References Cited

U.S. PATENT DOCUMENTS 5,881,957 A 3/1999 Mizuno et al.
6,131,826 A 10/2000 Teiwes
(Continued)

FOREIGN PATENT DOCUMENTS

JP 9-317607 A 12/1997
JP 11-512167 A 10/1999
(Continued)

OTHER PUBLICATIONS

Japanese Office Action dated Mar. 24, 2015 with English-language translation (six (6) pages).
(Continued)

*Primary Examiner* — Arthur O Hall
*Assistant Examiner* — Tuongminh Pham
(74) *Attorney, Agent, or Firm* — Crowell & Moring LLP

(57) ABSTRACT

A fuel injection valve is provided that can reduce variations in stroke length by reducing distortion during welding, and consequently can reduce variations in flow rate of injected fuel. The fuel injection valve has a nozzle; a fixed valve that is press-fit into a tip of the nozzle and has a fuel injection port from which the fuel is injected; and a movable element that forms a fuel seal section by abutting against the fixed valve, and opens and closes the fuel injection port. The fixed valve and the nozzle are fixed in place by welding at a position with no space due to press-fitting. A groove that serves as an empty space is provided in a continuation of a welded section that is formed in the fixed valve and the nozzle by the welding.

8 Claims, 10 Drawing Sheets

(51) Int. Cl.
*F02M 61/16* (2006.01)
*F02M 61/18* (2006.01)

(52) U.S. Cl.
CPC ..... *F02M 61/168* (2013.01); *F02M 61/18* (2013.01); *F02M 61/1813* (2013.01); *F02M 2200/8084* (2013.01); *F02M 2200/8092* (2013.01)

(58) Field of Classification Search
USPC ..... 239/584, 533.2, 585.1, 596, 600, 239/DIG. 19; 29/888.44, 890.143
See application file for complete search history.

(56) References Cited

U.S. PATENT DOCUMENTS

| | | | | |
|---|---|---|---|---|
| 7,798,433 | B2 | 9/2010 | Onishi et al. | |
| 2005/0040258 | A1 | 2/2005 | Dallmeyer et al. | |
| 2005/0280173 | A1 | 12/2005 | Wirtz et al. | |
| 2008/0296414 | A1* | 12/2008 | Kubota | F02M 51/0675 239/533.11 |
| 2009/0001626 | A1 | 1/2009 | Wirtz et al. | |
| 2011/0204276 | A1* | 8/2011 | Huemmer | B23K 33/006 251/366 |

FOREIGN PATENT DOCUMENTS

| | | | |
|---|---|---|---|
| JP | 2001-507097 | A | 5/2001 |
| JP | 2006-7775 | A | 1/2006 |
| JP | 2007-502935 | A | 2/2007 |
| JP | 2007-120375 | A | 5/2007 |
| JP | 2008-297966 | A | 12/2008 |
| JP | 2011-94632 | A | 5/2011 |

OTHER PUBLICATIONS

International Search Report dated Mar. 12, 2013 with English translation (five (5) pages).

* cited by examiner

[FIG. 1]
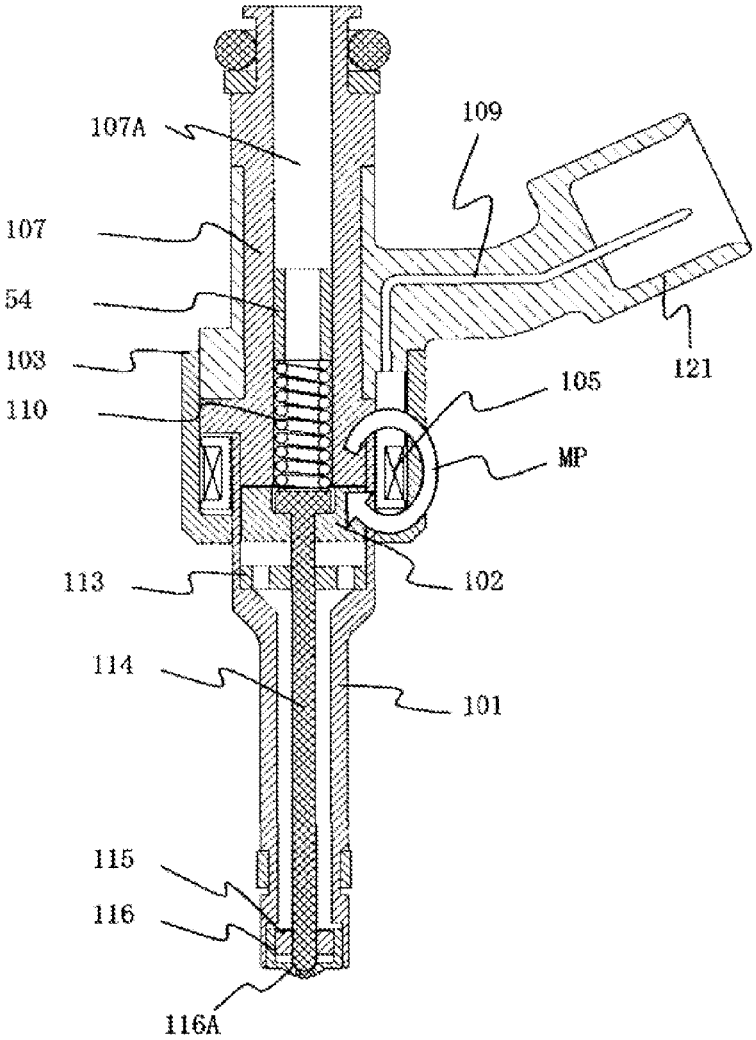
[FIG. 2]
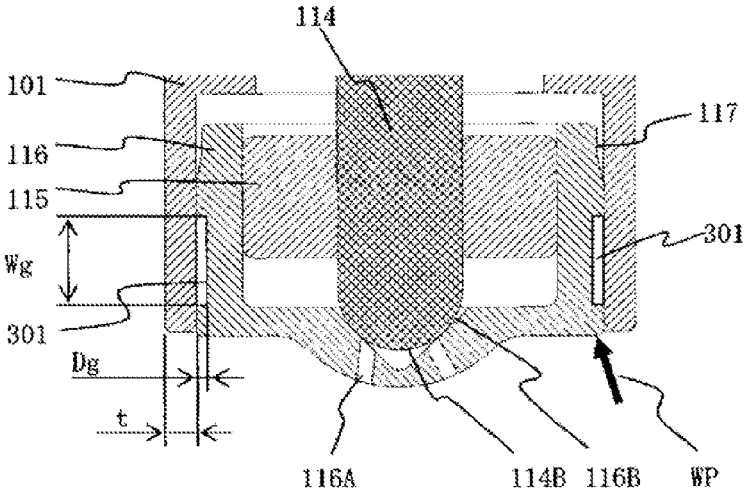

[FIG. 3]
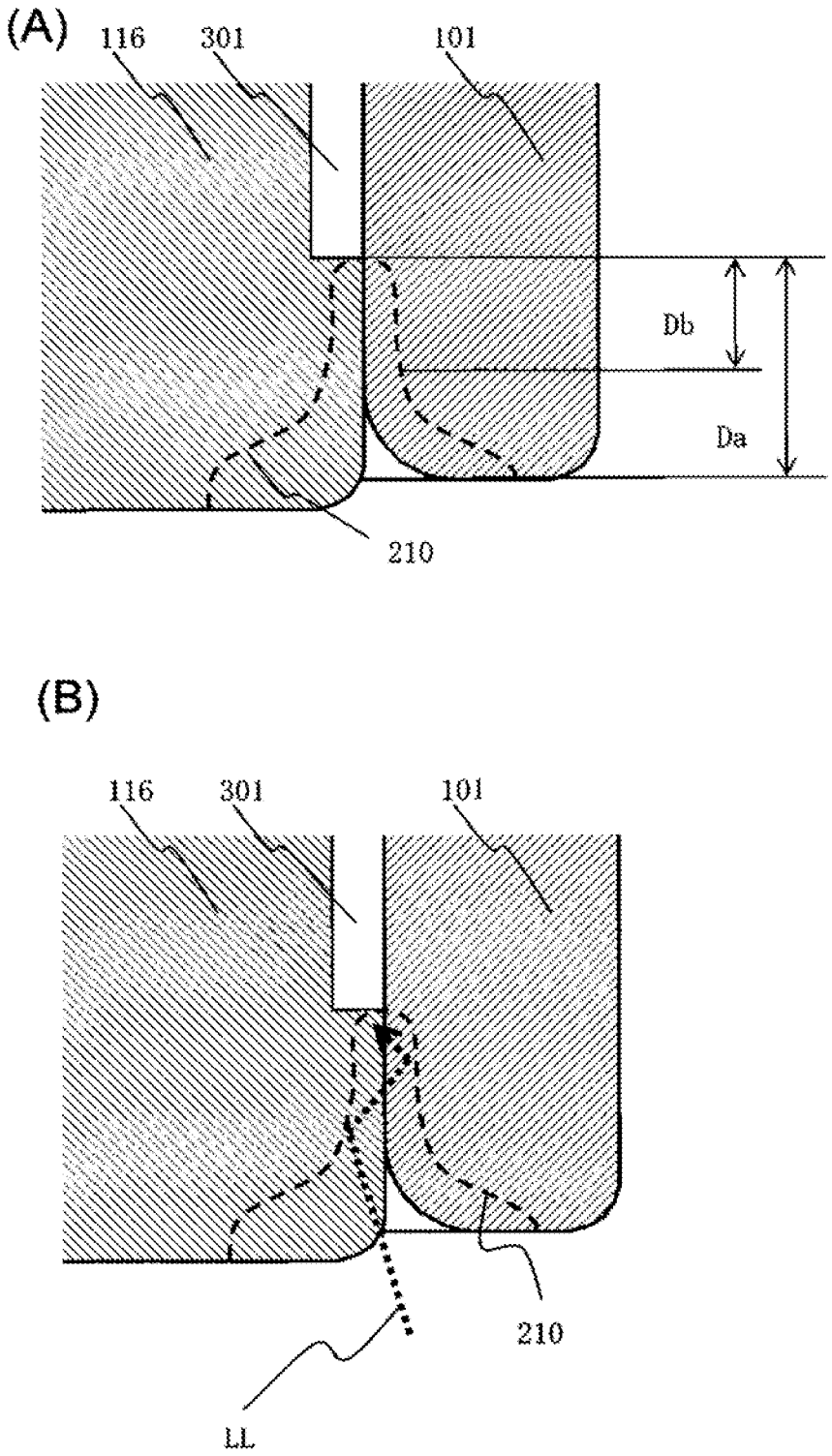

[FIG. 4]
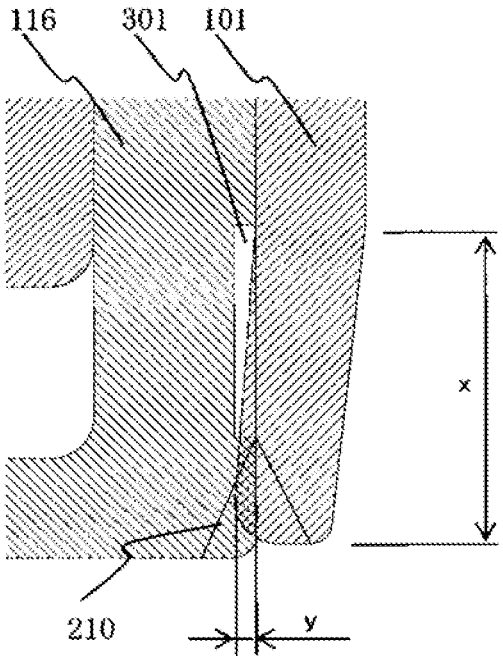
[FIG. 5]
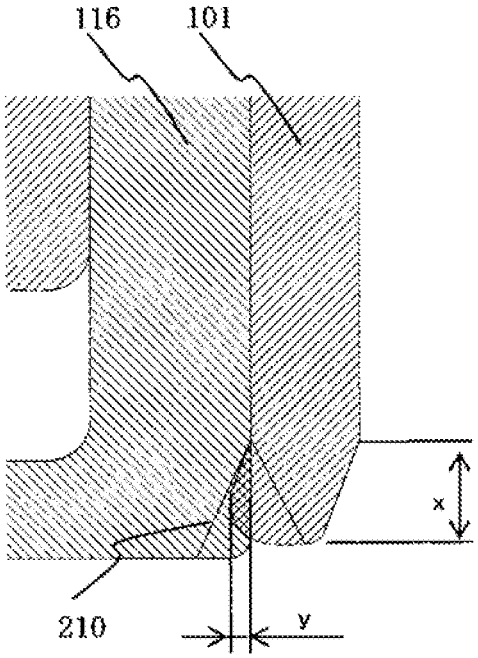

[FIG. 6]
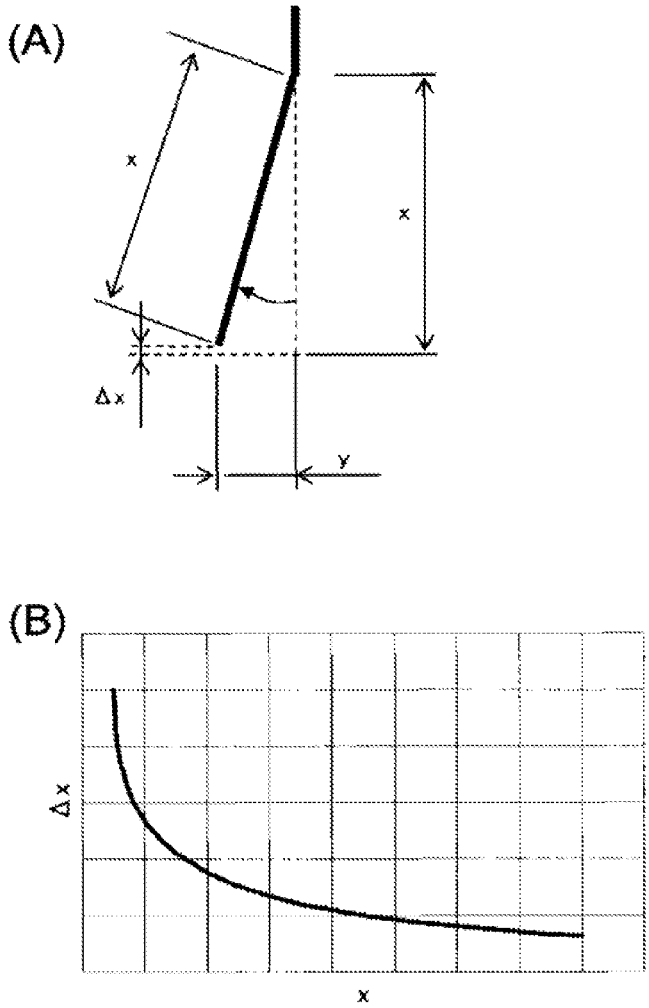
[FIG. 7]
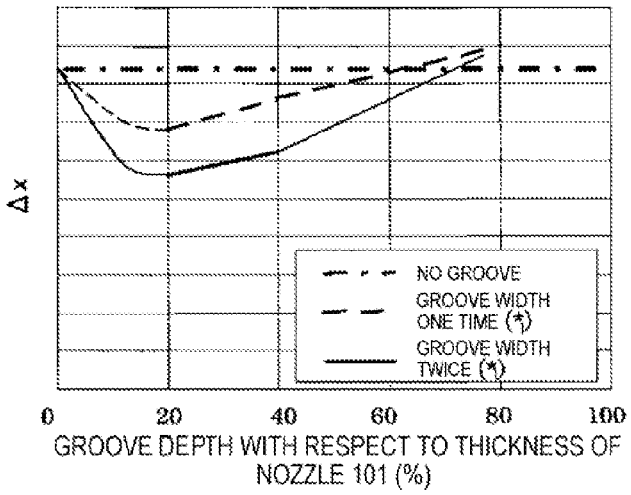

[FIG. 8]
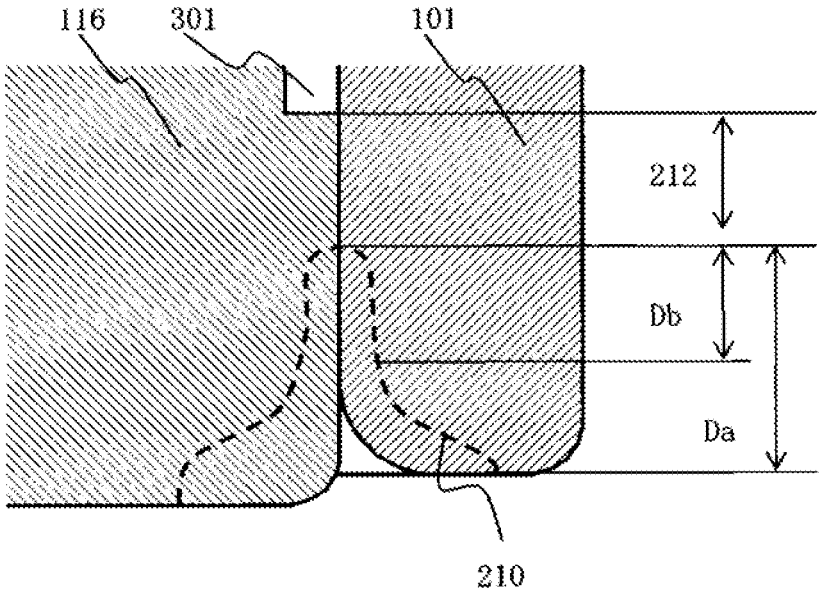
[FIG. 9]
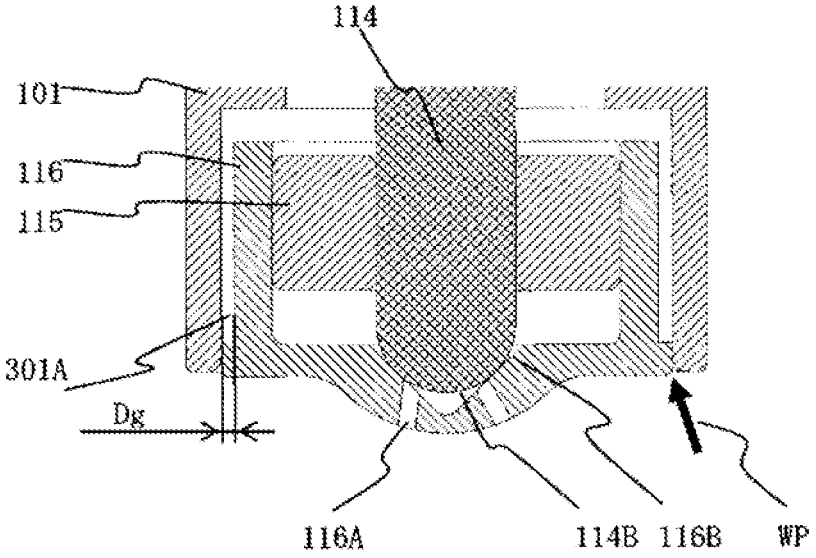

[FIG. 10]
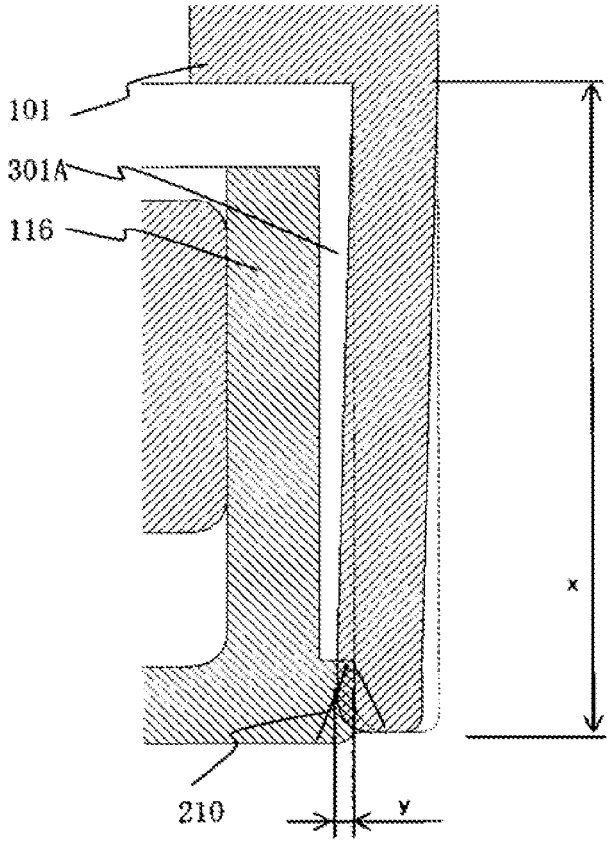
[FIG. 11]
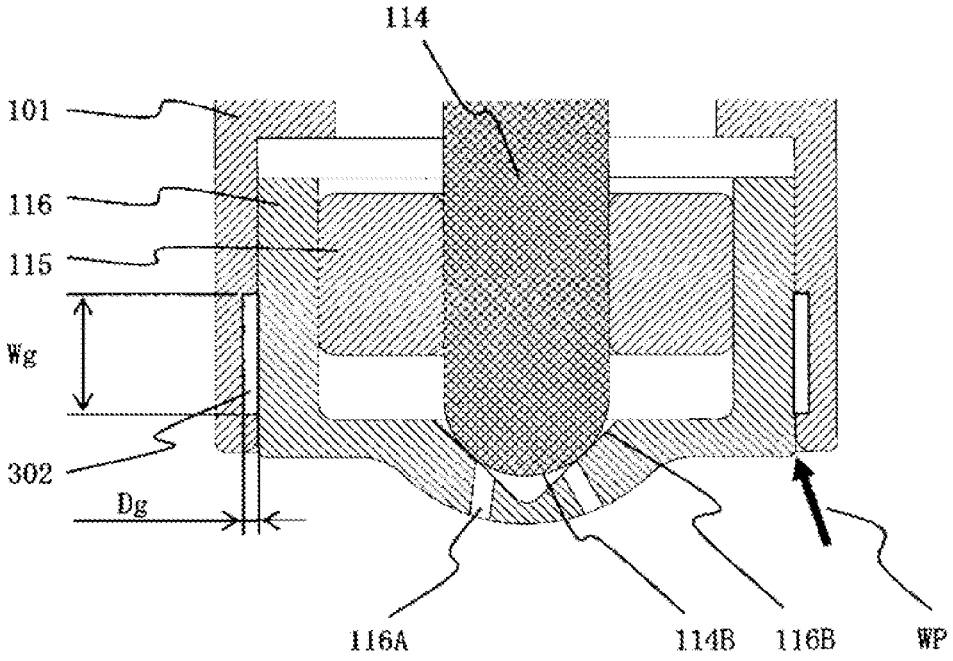

[FIG. 12]
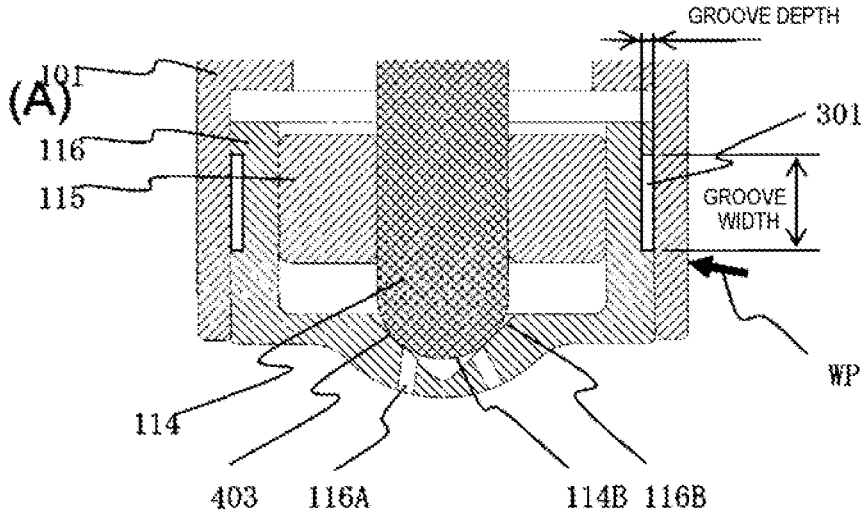
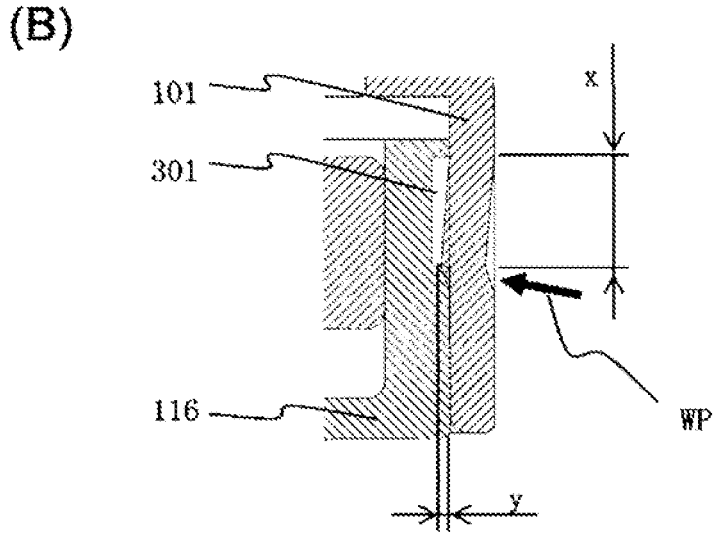

[FIG. 13]
(A)
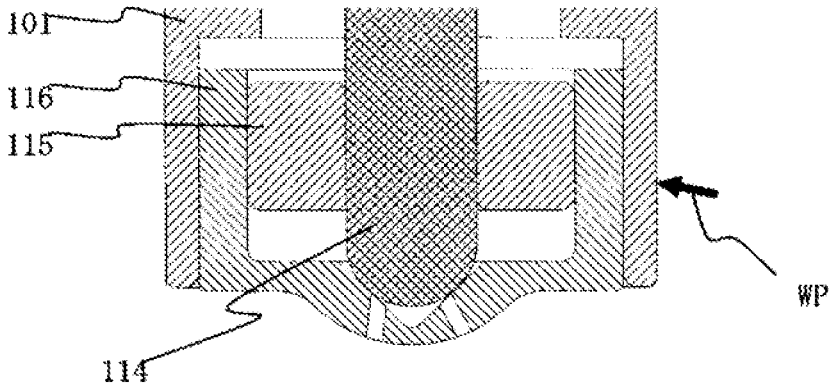
(B)
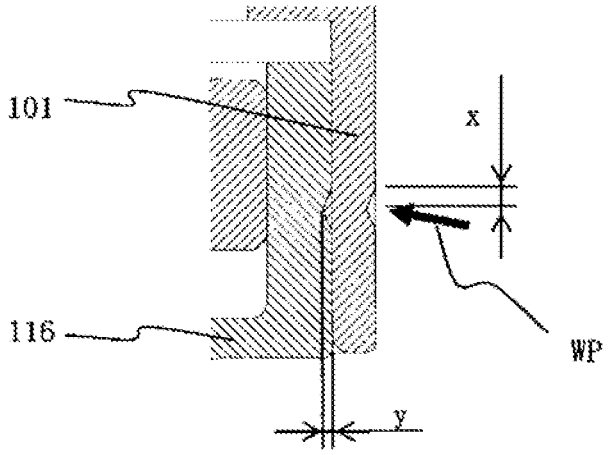

[FIG. 14]
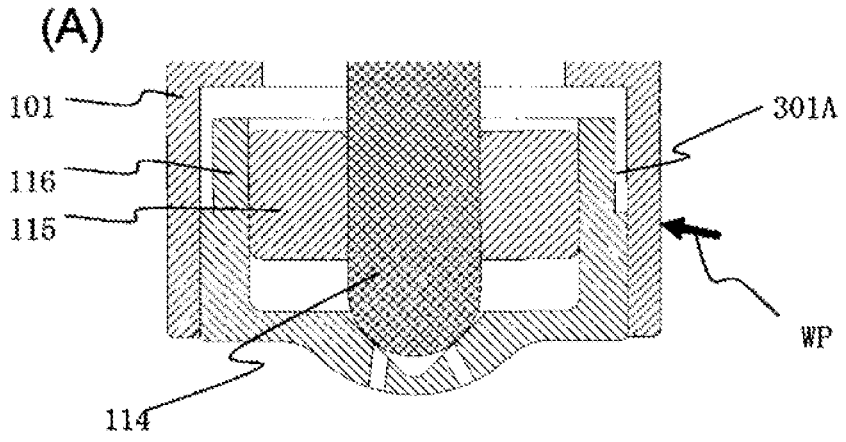
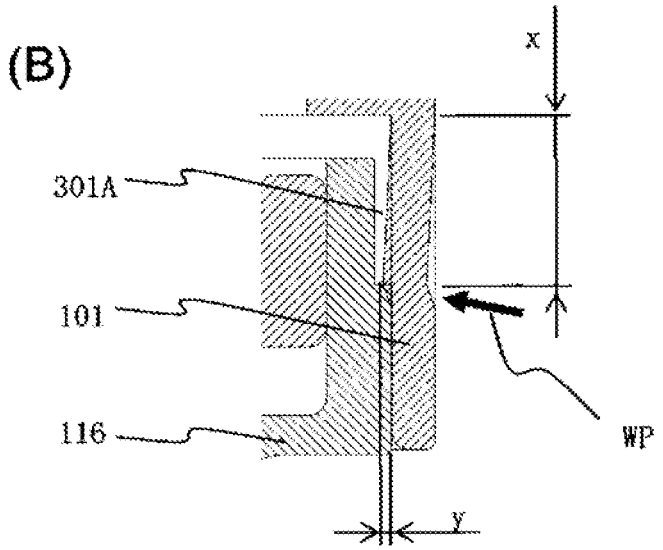

[FIG. 15]
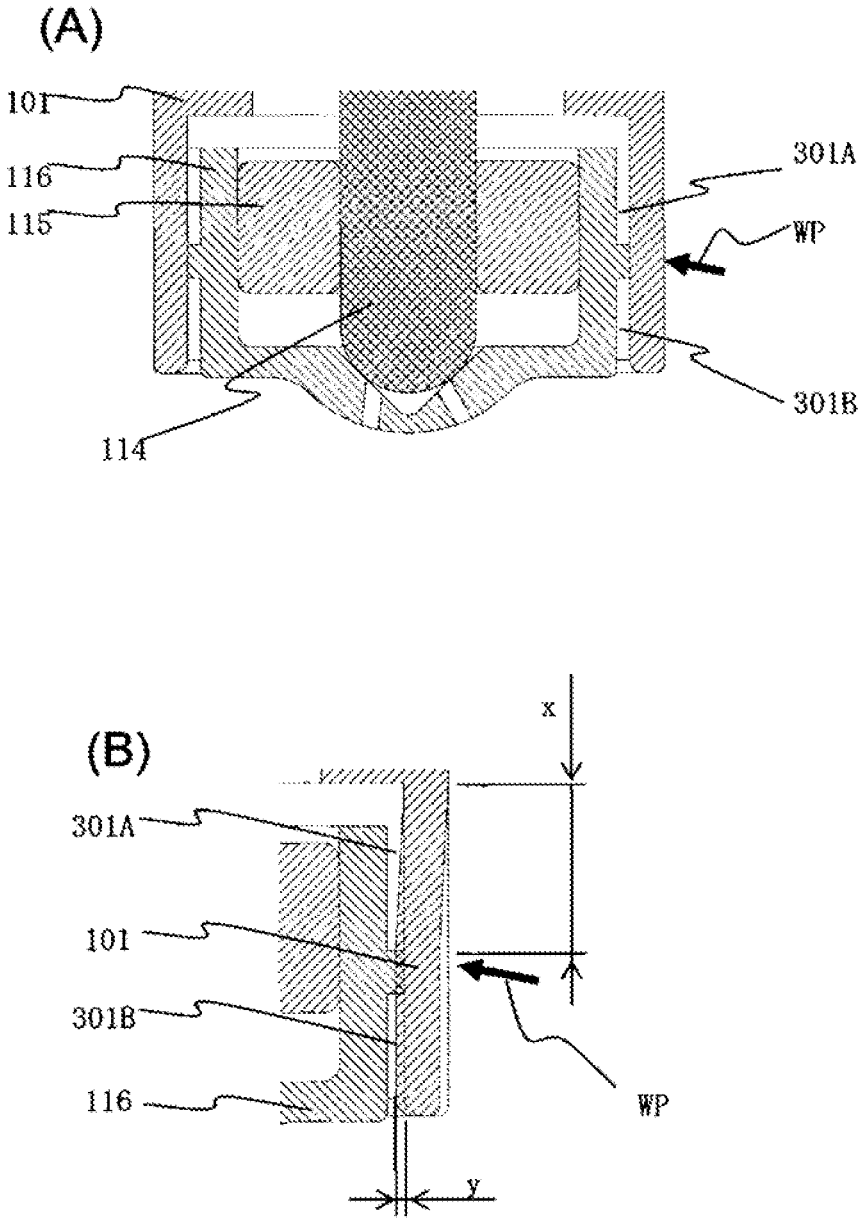

FUEL INJECTION VALVE

TECHNICAL FIELD

The present invention relates to a fuel injection valve that is used in an internal combustion engine and, in particular, to a fuel injection valve that is used in a cylinder injection engine for an automobile.

BACKGROUND ART

An electromagnetic fuel injection valve used in an internal combustion engine, particularly in a cylinder fuel injection system, needs to supply an adequate fuel injection amount to an engine cylinder in order to comply with regulations of and satisfy demands for emissions and fuel economy. At this time, large variations in flow rate for each injection result in different combustion states among cylinders, which in turn lead to strong engine vibration and large engine sound, and further cause generation of unburned hydrocarbon and soot in the emissions. In recent years, market needs for the emissions control and the excellent fuel economy have been increased, and further improvement of the variations in flow rate has been demanded.

As a reason for the variations in flow rate, an influence of a change in a fuel path that is caused by variations in stroke length of a movable element can be raised. The stroke length of the movable element is determined by an axial distance between a fixed core and a fixed valve that are joined to a nozzle and by a total length of the movable element including a movable core. The fixed valve is joined to the nozzle by laser welding. If the fixed valve moves in an axial direction due to distortion at the time, a distance therefrom to the fixed core is changed, and the stroke length is also changed. A larger change in stroke further increases the variations in stroke length.

In order to handle the above, a structure has conventionally been known in which a space is provided in a welded section to alleviate stress concentration in a penetrated section by welding, so as to reduce the distortion by welding (for example, see PTL 1).

CITATION LIST

Patent Literature

PTL 1: JP-A-2007-120375

SUMMARY OF INVENTION

Technical Problem

However, if the space is provided in a welded portion as described in PTL 1, a penetration amount to fill the space is required. Particularly, in a case of the laser welding, since a beam is dispersed by the space, further intense laser output is required. This leads not only to an increase in production costs but also to the large distortion since a dissolved section by welding is increased and an amount of contraction is thereby increased.

An object of the invention is to provide a fuel injection valve that can reduce variations in stroke length by reducing distortion during welding, and that can consequently reduce variations in flow rate of injected fuel.

Solution to Problem (1) In order to achieve the above object, the invention is a fuel injection valve that includes: a nozzle; a fixed valve that is press-fit into a tip of the nozzle and has a fuel injection port from which fuel is injected; and a movable element that forms a fuel seal section by abutting against the fixed valve and opens and closes the fuel injection port. The fixed valve and the nozzle are fixed in place by welding at a position with no space due to press-fitting, and the fuel injection valve includes an empty space in the continuation of a welded section that is formed in the fixed valve and the nozzle by the welding.

Due to such a configuration, variations in stroke length can be reduced by reducing distortion during the welding. As a result, variations in flow rate of the injected fuel can be reduced.

(2) In the above (1), the welded section is preferably a lower end surface of a press-fit section in the nozzle and the fixed valve, and the empty space is configured by a groove that is formed in the fixed valve on a contact surface between an outer periphery of the fixed valve and an inner periphery of the nozzle.

(3) In the above (2), the groove preferably reaches up to an upper end of the fixed valve.

(4) In the above (1), the welded section is preferably the press-fit section in the nozzle and the fixed valve, is at a position on the outer periphery of the nozzle, and is formed with a penetrated section so as to penetrate from the nozzle to the fixed valve, and the empty space is preferably configured by the groove that is formed in the fixed valve.

(5) In the above (4), the groove preferably reaches up to the upper end of the fixed valve.

(6) In the above (2) or (4), the press-fit section is preferably provided in the continuation of the penetrated section by the welding.

(7) In the above (1), the empty space is preferably the groove that is formed in the nozzle.

Advantageous Effects of Invention

According to the invention, the variations in stroke length can be reduced by reducing the distortion during the welding, and as a result, the variations in flow rate of the injected fuel can be reduced.

BRIEF DESCRIPTION OF DRAWINGS

FIG. 1 is a cross-sectional view for showing an overall configuration of a fuel injection valve according to an embodiment of the invention.

FIG. 2 is an enlarged cross-sectional view for showing the configuration of main components of the fuel injection valve according to the embodiment of the invention.

FIG. 3 is an enlarged cross-sectional view for showing the configuration of main components of a welded section of the fuel injection valve according to the embodiment of the invention.

FIG. 4 is an explanatory view of a groove that is provided in the welded section of the fuel injection valve according to the embodiment of the invention.

FIG. 5 is an explanatory view of a case where the groove is not provided for a comparative explanation.

FIG. 6 is an explanatory view of deformation of a nozzle in the welded section of the fuel injection valve according to the embodiment of the invention.

FIG. 7 is an explanatory view of the deformation of the nozzle in the welded section of the fuel injection valve according to the embodiment of the invention.

FIG. 8 is a cross-sectional view for showing a second shape of the groove that is provided in the welded section of the fuel injection valve according to the embodiment of the invention.

FIG. 9 is a cross-sectional view for showing a third shape of the groove that is provided in the welded section of the fuel injection valve according to the embodiment of the invention.

FIG. 10 is a cross-sectional view for showing the third shape of the groove that is provided in the welded section of the fuel injection valve according to the embodiment of the invention.

FIG. 11 is a cross-sectional view for showing a fourth shape of the groove that is provided in the welded section of the fuel injection valve according to the embodiment of the invention.

FIG. 12 is an enlarged cross-sectional view for showing the configuration of the main components of the fuel injection valve according to another embodiment of the invention.

FIG. 13 is an enlarged cross-sectional view for showing the configuration of the main components of the fuel injection valve in a comparative example.

FIG. 14 is an enlarged cross-sectional view for showing the configuration of the main components in a second configuration example of the fuel injection valve according to another embodiment of the invention.

FIG. 15 is an enlarged cross-sectional view for showing the configuration of the main components in a third configuration example of the fuel injection valve according to another embodiment of the invention.

DESCRIPTION OF EMBODIMENTS

A description will hereinafter be made on a configuration of a fuel injection valve according to an embodiment of the invention by using FIG. 1 to FIG. 10.

First, an overall configuration of the fuel injection valve according to this embodiment will be described by using FIG. 1. FIG. 1 is a cross-sectional view for showing the overall configuration of the fuel injection valve according to the embodiment of the invention.

A high-pressure pump, which is not shown, for pressurizing and supplying fuel and a piping for connecting the high-pressure pump and an upper section of a fixed core 107 are arranged in the upper section of the fixed core 107. The fuel supplied from the high-pressure pump is supplied in a pressurized state to a through hole 107A that is a fuel path at the center of the fixed core 107. The fuel is supplied to the inside of a nozzle 101 through a fuel path provided in a movable core 102 and a fuel path provided in a movable element guide 113.

A seat surface of a spring 110 is provided on an upper end surface of a movable element 114. An adjustment element 54 abuts against an upper end surface of the spring 110 that is on an opposite side of the movable element 114. An urging force of the spring 110 to the movable element 114 can be changed by rotating the adjustment element 54 to change the intensity to compress the spring 110 in an axial direction. After the adjustment of the urging force, the adjustment element 54 is fixed to the fixed core 107.

The movable element 114 is held by a guide member 115 and the movable element guide 113 so that it can reciprocate vertically. In a valve closed state in which an electromagnetic coil 105 is not energized, the movable element 114 abuts against a fixed valve 116 by the urging force of the spring 110. The nozzle 101 has a cylindrical shape. The fixed valve 116 has a bottomed cylindrical shape (a cup shape). The fixed valve 116 is fixed by welding after being press-fit to an open end of the nozzle 101. Plural fuel injection ports 116A are formed at a tip of the fixed valve 116. In the valve closed state in which the electromagnetic coil 105 is not energized, the tip of the movable element 114 abuts against and closes the fuel injection port 116A, and thereby blocks a flow of the fuel supplied from the high-pressure pump.

The electromagnetic coil 105 is arranged on an outer periphery of the fixed core 107 and is formed with a toroidal magnetic path that is indicated by an arrow MP through a housing 103, the nozzle 101, and the movable core 102. The movable core 102 has an integral structure with the movable element 114.

A plug for supplying electric power by a battery voltage is connected to a connector 121 that is formed at a tip of a conductor 109. The conductor 109 is connected to the electromagnetic coil 105. The energization/non-energization of the electromagnetic coil 105 is controlled by a controller, which is not shown, through the conductor 109.

During the energization of the electromagnetic coil 105, a magnetic attraction force is generated between the movable core 102 and the fixed core 107 due to magnetic flux that passes through the magnetic path MP. The movable core 102 is attracted and thus moves upward until it hits a lower end surface of the fixed core 107. As a result, the movable element 114 is separated from the fixed valve 116 to cause a valve opened state, and the fuel supplied from the through hole that is the fuel path at the center of the fixed core 107 is injected from the injection port 116A into a combustion chamber of the engine.

When the energization to the electromagnetic coil 105 is cut off, the magnetic flux in the magnetic path MP disappears, and the magnetic attraction force also disappears. In this state, a spring force of the spring 110 that pushes the movable element 114 in a valve closing direction is applied to the movable element 114. As a result, the movable element 114 is pushed back to a valve closing position at which it contacts the fixed valve 116. In other words, the fuel injection valve of this embodiment is a fuel injection valve of normally closed type.

Next, a configuration of main components of the fuel injection valve according to this embodiment will be described by using FIG. 2.

FIG. 2 is an enlarged cross-sectional view for showing the configuration of the main components of the fuel injection valve according to the embodiment of the invention. The same reference signs as those used in FIG. 1 indicate the same components. In addition, dimensions and an amount of deformation are shown in an exaggerated manner for the explanation.

The guide member 115 is provided with a fuel path that is not shown and communicates between an upstream side surface and a downstream side surface of the guide member 115. A movable element side seat surface 114B in a spherical shape is arranged on a downstream side of the movable element 114. In addition, a fixed valve side seat surface 116B in a conical shape is arranged in the fixed valve 116. In order to form the seat surface 116B, an axial length of the fixed valve 116, which is a total length thereof, is limited in view of workability and productivity.

In the valve closed state, the movable element side seat surface 114B and the fixed valve side seat surface 116B contact each other to constitute a circular seat section for stopping a supply of the fuel from the upstream side to the injection port 116A.

A moving distance of the movable element 114 from a position in the valve closed state as described above to a position at which it hits the lower end surface of the fixed core 107 after the valve is opened is set as a stroke length. Since the fuel path near the seat section is narrow and thus has high fluid resistance, the stroke length has a strong influence on a flow rate during a full stroke. Thus, the stroke length is adjusted with sub-micron accuracy. The stroke length is adjusted by adjusting a press-fit amount when the fixed valve 116 is press-fit into the nozzle 101. In addition, a target stroke length is set such that a desired flow rate for the specification of the engine to be used can be obtained.

Here, a material used for the fixed valve 116 and the cylindrical nozzle 101 is stainless steel.

After the fixed valve 116 is adjusted to achieve the target stroke length, a whole periphery thereof is welded in a welded section WP, the fixed valve 116 and the nozzle 101 are fixed, and the fuel is thereby sealed. In order to minimize the distortion by the welding, laser is used for the welding.

The fixed valve 116 is configured to be press-fit into the nozzle 101. In order to facilitate assembly during press-fitting, an upper end of the fixed valve 116 is provided with a fixed valve guide 117, a diameter of which is slightly smaller than an outermost diameter of the fixed valve 116. In addition, an opening of the welded section WP between the fixed valve 116 and the nozzle 101 has a rounded shape.

As a penetrated section by the welding is deeper (in the axial direction), joint strength between the fixed valve 116 and the nozzle 101 is increased. Meanwhile, as a width of the penetrated section (in a radial direction) is increased, a contraction rate thereof in the radial direction is increased, and the distortion in the radial direction is increased.

Here, a description will be made on the configuration of main components of the welded section of the fuel injection valve according to this embodiment by using FIG. 3.

FIG. 3 is an enlarged cross-sectional view for showing the configuration of the main components of the welded section of the fuel injection valve according to the embodiment of the invention. The same reference signs as those used in FIG. 1 and FIG. 2 indicate the same components. In addition, the dimensions and the amount of deformation are shown in the exaggerated manner for the explanation.

As shown in FIG. 3(A), since the welding is performed in a press-fit section with no space in the welded section WP, a cross section of the welded section WP after the welding has a penetrated wine cup shape that is indicated by a depth Da of a penetrated section 210 as shown in the drawing.

In the laser welding, a portion irradiated with laser is evaporated depending on conditions such as output and a moving speed, and is formed with a dent when vapor pressure is applied to a melted portion.

In addition, as shown in FIG. 3(B), a laser beam LL is repeatedly reflected and absorbed in the dent, the deep penetration shape, a width of which is as narrow as approximately 0.2 to 0.4 mm and is also constant, can thereby be obtained. Such a deep penetrated section with the narrow and constant width is referred to as a "keyhole".

In this example, the welded section WP is configured to adopt a press-fit structure with no space in order to perform the laser welding of a keyhole shape, and an area with a depth Db in an upper section of the penetrated section 210 that is indicated by a broken line in FIG. 3(A) serves as the keyhole.

Here, in this embodiment, as shown in FIG. 2, the fixed valve 116 is provided with a groove 301 such that the groove serves as an empty space in the continuation of the welded section WP. The groove 301 is newly provided in this embodiment to reduce the distortion by the welding. Conventionally, the groove 301 is not provided. A groove width Wg of the groove 301 is set to be approximately twice a thickness t of the nozzle 101, and a depth Dg thereof is set to be approximately 20% of the thickness t. It should be noted that a maximum value of the groove width Wg of the groove 301 is restricted to approximately twice the thickness t by the total length of the fixed valve 116 and the fixed valve guide 117.

Here, a description will be made on a function of the groove that is provided in the welded section of the fuel injection valve according to this embodiment by using FIG. 4 and FIG. 5.

FIG. 4 is an explanatory view of the groove that is provided in the welded section of the fuel injection valve according to the embodiment of the invention. FIG. 5 is an explanatory view of a case where the groove is not provided for a comparative explanation. The same reference signs as those used in FIG. 1 to FIG. 3 indicate the same components. In addition, the dimensions and the amount of deformation are shown in the exaggerated manner for the explanation.

Here, FIG. 4 is an enlarged view of the welded section in a case where the groove 301 shown in FIG. 2 is provided. On the other hand, FIG. 5 is an enlarged view of the welded section in a case where the groove 301 shown in FIG. 2 is not provided. The penetrated section 210 is simulated by a solid straight line.

Here, the tip of the nozzle 101 is deformed in an area of x by an amount of contraction y in the radial direction after the welding shown in FIG. 4 and FIG. 5.

Next, a description will be made on an effect of the groove that is provided in the welded section of the fuel injection valve according to this embodiment by using FIG. 6 and FIG. 7.

FIG. 6 and FIG. 7 are explanatory views of the deformation of the nozzle in the welded section of the fuel injection valve according to the embodiment of the invention.

First, the appearance of the deformation of the nozzle 101 during the welding will be described by using FIG. 6(A). A thick solid line in FIG. 6(A) represents the nozzle, and as in FIG. 4, the tip of the nozzle 101 is deformed in the area of the length x by the amount of contraction y. At this time, the tip of the nozzle 101 moves upward by Δx. Due to this movement, the fixed valve 116 that is joined to the nozzle 101 by the welding also moves upward by Δx.

The amount of movement Δx is geometrically defined by the length x and the amount of contraction y, and establishes a relation in an equation (1).

$$\Delta x = x - (\sqrt{(x^2 - y^2)}) \quad (1)$$

Here, FIG. 6(B) shows the relation between x and Δx in the equation (1) when a welding condition is constant and the amount of contraction y in the radial direction is regarded to be constant. When the length x is increased, the amount of movement Δx is rapidly reduced. Thus, in order to reduce the amount of movement Δx, it is effective to increase the length x.

In this embodiment, since the groove 301 is provided as shown in FIG. 4, a starting point of the deformation of the nozzle 101 is moved to the upper end of the groove 301, and the area x is larger than that in the case where the groove 301 is not provided. FIG. 4 schematically shows the state in which the tip of the nozzle 101 is deformed.

FIG. 7 shows a calculation result of the effect of the groove 301 and an influence of a case where the groove width and the groove depth of the groove 301 are changed by a finite element method.

In FIG. 7, a horizontal axis represents the groove depth x, and a vertical axis represents the amount of contraction Δx. From a perspective of the workability, the groove depth x becomes the smallest when it is 20% of the thickness t of the nozzle 101. A reason for this is because, when the thickness t of the nozzle 101 is 0.5 mm, for example, a groove having a depth of 20% or smaller, that is, 0.1 mm or smaller is difficult to be processed. However, FIG. 7 also shows a calculation result in a case where the groove depth is shallow and is 20% or less. In addition, two standards of one time or twice the thickness t are set for the groove width. Here, the "time" refers to a ratio to the thickness of the nozzle.

The result in FIG. 7 shows a tendency that Δx can be small when the groove width is large and the groove depth is small. In a calculation range, within a range that the groove depth is 0 to 60% of the thickness t, Δx is smaller than that in the case where the groove is not provided. However, a problem of the processing is raised when the groove depth is 20% or smaller. Accordingly, when this point is considered, a range of 20 to 60% is suitable. In a case where the groove width is one time and the groove depth exceeds 60%, the amount of change Δx tends to be increased again in comparison with the case where the groove is not provided. It is assumed that this is because the deformation occurs due to reduced strength of the fixed valve 116.

Next, a description will be made on a second shape of the groove that is provided in the welded section of the fuel injection valve according to this embodiment by using FIG. 8.

FIG. 8 is a cross-sectional view for showing the second shape of the groove that is provided in the welded section of the fuel injection valve according to the embodiment of the invention. The same reference signs as those used in FIG. 1 to FIG. 5 indicate the same components.

In this example, as shown in FIG. 8, a press-fit section 212 is provided in the continuation of the penetrated section 210.

Stress generated by the contraction of the welded section is substantially larger than yield stress of the material, and thus the material reaches a plastic region and is significantly deformed. Thus, when the press-fit section 212 is in a high stress area due to the contraction by the welding, the entire press-fit section 212 is significantly deformed along with the contraction of the penetrated section 210. In other words, when the press-fit section 212 is sufficiently short, the starting point of the deformation of the nozzle 101 is set at the upper end of the groove 301 as shown in FIG. 4 and as in the case of the first example, and thus the large area x can be obtained in comparison with the case where the groove 301 is not provided.

In the calculation result shown in FIG. 6, the area in which the stress generated due to the contraction by the welding is higher than the yield stress of the material reaches 80% of the penetration depth Da. Accordingly, in a case of this example, the press-fit section 212 may be 80% or smaller of the penetration depth Da. In the case shown in FIG. 3(*a*), the press-fit section 212 is not provided, and the area corresponds to 0%.

Next, a description will be made on a third shape of the groove that is provided in the welded section of the fuel injection valve according to this embodiment by using FIG. 9 and FIG. 10.

FIG. 9 and FIG. 10 are cross-sectional views for showing the third shape of the groove that is provided in the welded section of the fuel injection valve according to the embodiment of the invention. The same reference signs as those used in FIG. 1 to FIG. 5 indicate the same components.

Compared to the first example shown in FIG. 2, in this example, as shown in FIG. 9, a groove 301A reaches the upper end surface of the fixed valve 116.

In this case, as shown in FIG. 10, the area x can further be increased when compared to that in the first example.

In addition, in this example, the groove 301A has a function of the fixed valve guide 117 that is in the case of the first example, and thus the fixed valve 116 can still be assembled easily to the nozzle 101.

Next, a description will be made on a fourth shape of the groove that is provided in the welded section of the fuel injection valve according to this embodiment by using FIG. 11.

FIG. 11 is a cross-sectional view for showing the fourth shape of the groove that is provided in the welded section of the fuel injection valve according to the embodiment of the invention. The same reference signs as those used in FIG. 1 to FIG. 5 indicate the same components.

In the first example shown in FIG. 2, the groove 301 is provided in the fixed valve 116. Compared to this, in this example, a groove 302, a groove width of which is twice the thickness t and a groove depth of which is 20% of the thickness t, is provided on an inner periphery of the nozzle 101 that faces an outer peripheral surface of the fixed valve 116, so as to serve as the empty space in the continuation of the welded section. The effect of the empty space in the continuation of the welded section is same as that in the first example. In addition, in the other examples described above, the same effect can be obtained by providing the empty space in the continuation of the welded section on the nozzle 101 side.

Furthermore, the empty space in the continuation of the welded section may be configured by combining the above-mentioned groove 301 and the groove 302.

According to this embodiment described above, a change in the stroke length of the movable element can be reduced by reducing the distortion during the welding and the amount of movement of the fixed valve in the axial direction due to the distortion. As a result, since the variations in the stroke length are reduced, the variations in flow rate can be reduced.

Next, a description will be made on the configuration of the fuel injection valve according to another embodiment of the invention by using FIG. 12 to FIG. 15. The overall configuration of the fuel injection valve according to this embodiment is same as that shown in FIG. 1.

Next, a description will be made on a configuration of main components of the fuel injection valve according to this embodiment by using FIG. 12. FIG. 13 shows a configuration in a comparative example.

FIG. 12 is an enlarged cross-sectional view for showing the configuration of the main components of the fuel injection valve according to another embodiment of the invention. FIG. 12(B) is an enlarged view of the main components in FIG. 12(A) for explaining the amount of deformation of the nozzle. FIG. 13 is an enlarged cross-sectional view for showing the configuration of the main components of the fuel injection valve in the comparative example. FIG. 13(B) is an enlarged view of the main components in FIG. 13(A) for explaining the amount of deformation of the nozzle. The same reference signs as those used in FIG. 1 and FIG. 2 indicate the same components. In addition, the dimensions and the amount of deformation are shown in the exaggerated manner for the explanation.

In this embodiment, after the fixed valve 116 is press-fit into the nozzle 101, the welding is performed at a position in the welded section WP on the outer peripheral side of the nozzle 101 as shown in FIG. 12(A) and FIG. 12(B). The nozzle 101 and the fixed valve 116 are fixed by the penetration from the nozzle 101 to the fixed valve 116 by welding.

As shown in FIG. 12(A), in this embodiment, the groove 301 that serves as the empty space is continuously provided from the welded section WP in an upward direction. The groove 301 is set such that the groove width is twice the thickness t of the nozzle 101 and the groove depth is 20% of the thickness t.

FIG. 12(B) shows the area x of deformation and the amount of contraction y in the radial direction of the nozzle 101 that corresponds to FIG. 12(A). A relation among the amount of change Δx that shows a change in the stroke length, the area x, and the amount of contraction y is same as that in the above-described examples, and the amount of change Δx can be reduced as the area x is increased.

FIG. 13 shows a conventional configuration in which the groove 301 shown in FIG. 12 is not provided. In this case, as shown in FIG. 13(B), the area x is smaller than that shown in FIG. 12(B). In other words, when the groove 301 is provided as in this embodiment shown in FIG. 12(B), the area x can be increased in comparison with a conventional case shown in FIG. 13(B) where the groove is not provided.

Next, a description will be made on the configuration of the main components in a second configuration example of the fuel injection valve according to this embodiment by using FIG. 14.

FIG. 14 is an enlarged cross-sectional view for showing the configuration of the main components in the second configuration example of the fuel injection valve according to another embodiment of the invention. FIG. 14(B) is an enlarged view of the main components in FIG. 14(A) for explaining the amount of deformation of the nozzle.

In this example, as shown in FIG. 14(A), the groove 301A is provided up to the upper end of the fixed valve 116 so as to serve as the empty space that is continuous from the welded section WP in the upward direction. In this case, the groove 301A has the groove depth that is 20% of the thickness t.

In addition, as shown in FIG. 14(B), a relation among the amount of change Δx that shows the change in the stroke length, the area x, and the amount of contraction y is same as that in the above-described examples, and the amount of change Δx can be reduced as the area x is increased.

Next, a description will be made on the configuration of the main components in a third configuration example of the fuel injection valve according to this embodiment by using FIG. 15.

FIG. 15 is an enlarged cross-sectional view for showing the configuration of the main components in the third configuration example of the fuel injection valve according to another embodiment of the invention. FIG. 15(B) is an enlarged view of the main components in FIG. 15(A) for explaining the amount of deformation of the nozzle.

In this example, as shown in FIG. 15(A), the groove 301A and a groove 301B are provided. The groove 301A is provided up to the upper end of the fixed valve 116 so as to serve as the empty space that is continuous from the welded section WP in the upward direction. The groove 301B is provided up to a lower end of the fixed valve 116 so as to serve as the empty space that is continuous from the welded section WP in a downward direction. In this case, the groove 301A has the groove depth that is 20% of the thickness t.

In addition, as shown in FIG. 15(B), a relation among the amount of change Δx that shows the change in the stroke length, the area x, and the amount of contraction y is same as that in the above-described examples, and the amount of change Δx can be reduced as the area x is increased.

It should be noted that, in the examples shown in FIG. 12, FIG. 14, and FIG. 15, the press-fit section may be provided in the continuation of the penetrated section by the welded section WP as shown in FIG. 8.

Furthermore, as shown in FIG. 11, the groove may be provided on the nozzle 101 side.

According to this embodiment that has been described so far, the change in the stroke length of the movable element can also be reduced by reducing the distortion during the welding and the amount of movement of the fixed valve in the axial direction due to the distortion. As a result, since the variations in the stroke length are reduced, the variations in flow rate can be reduced.

REFERENCE SIGNS LIST

54: adjustment element
101: nozzle
102: movable core
103: housing
105: electromagnetic coil
107: fixed core
110: spring
113: movable element guide
114: movable element
114B: movable element side seat surface
115: guide member
116: fixed valve
116A: fuel injection port
116B: fixed valve side seat surface
117: fixed valve guide
121: connector
MP: magnetic path
210: penetrated section by welding
WP: welded section
301, 302: groove

The invention claimed is:

1. A fuel injection valve comprising:
a nozzle;
a fixed valve that is press-fit into a tip of the nozzle and has a fuel injection port from which fuel is injected; and
a movable element that forms a fuel seal section by abutting against the fixed valve and that opens and closes the fuel injection port, wherein
the fixed valve and the nozzle are fixed in place by welding at a position with no space due to press-fitting,
the fuel injection valve comprises a gap in a continuation of a welded section formed in the fixed valve and the nozzle by the welding,
the gap has a width that is twice of a thickness of the nozzle, and
the gap has a depth that is 20% of the thickness of the nozzle.

2. The fuel injection valve according to claim 1, wherein an outer diameter surface of the nozzle is gradually inclined, relative to a longitudinal axis thereof, toward the fixed valve beginning at an upper end of the gap until a distal end of the nozzle.

3. The fuel injection valve according to claim 2, wherein the welded section is a lower end surface of a press-fit section in the nozzle and the fixed valve, and the gap is configured by a groove that is formed in the fixed valve on a contact surface between an outer periphery of the fixed valve and an inner periphery of the nozzle.

4. The fuel injection valve according to claim 3, wherein the groove reaches up to an upper end of the fixed valve.

5. The fuel injection valve according to claim 2, wherein the welded section is a press-fit section in the nozzle and the fixed valve, is at a position on an outer periphery of the fixed valve, and is formed with a penetrated section so as to penetrate from the nozzle to the fixed valve, and the gap is configured by a groove that is formed in the fixed valve.

6. The fuel injection valve according to claim 5, wherein the groove reaches up to an upper end of the fixed valve.

7. The fuel injection valve according to claim 3, wherein the press-fit section is provided in the continuation of a penetrated section by the welding.

8. The fuel injection valve according to claim 2, wherein the gap is a groove that is formed in the nozzle.

* * * * *